US005397034A

United States Patent [19]

Wunsch

[11] Patent Number: 5,397,034

[45] Date of Patent: Mar. 14, 1995

[54] FINELY ATOMIZING DEVICE FOR FLUIDS

[76] Inventor: Eckart Wunsch, Buchenstrasse 5, D-72355 Schomberg-Langenbrand, Germany

[21] Appl. No.: 120,690

[22] Filed: Sep. 13, 1993

[30] Foreign Application Priority Data

Sep. 23, 1992 [DE] Germany ..... 42 31 826.2

[51] Int. Cl.[6] ..... B05B 9/04; B67D 5/40

[52] U.S. Cl. ..... 222/333; 222/382; 222/383; 222/464

[58] Field of Search ..... 222/333, 382, 383, 464, 222/211; 239/332, 333

[56] References Cited

U.S. PATENT DOCUMENTS

| | | | |
|---|---|---|---|
| 2,117,747 | 5/1938 | Smith et al. | 222/527 X |
| 3,137,326 | 6/1964 | Welty et al. | 222/382 X |
| 3,490,656 | 1/1970 | Taschner | 222/464 X |
| 3,667,655 | 6/1972 | Knieriem | 222/464 |
| 3,904,116 | 9/1975 | Jones et al. | 222/333 X |
| 3,993,250 | 11/1976 | Shure | 222/383 X |
| 4,153,203 | 5/1979 | Tada | 239/333 |
| 4,154,375 | 5/1979 | Bippus | 222/333 X |
| 4,162,037 | 7/1979 | Koyama | 222/333 X |
| 4,187,959 | 2/1980 | Pelton | 222/333 X |
| 4,189,098 | 2/1980 | Wagner et al. | 239/332 X |
| 4,618,099 | 10/1986 | Nagao et al. | 222/332 X |
| 4,621,770 | 11/1986 | Sayen | 239/332 X |
| 4,767,033 | 8/1988 | Gemperle | 222/383 |
| 4,830,235 | 5/1989 | Miller | 222/464 |
| 4,925,105 | 5/1990 | Lin | 222/333 X |
| 5,014,884 | 5/1991 | Wunsch | 239/333 X |
| 5,150,841 | 9/1992 | Silvenis et al. | 222/333 X |
| 5,195,664 | 3/1993 | Rhea | 222/382 |
| 5,215,227 | 6/1993 | Farner | 222/382 X |

FOREIGN PATENT DOCUMENTS

| | | | |
|---|---|---|---|
| 9110779 | 2/1993 | Denmark . | |
| 0211122 | 2/1987 | European Pat. Off. . | |
| 0365770 | 5/1990 | European Pat. Off. | 222/333 |
| 0477588 | 4/1992 | European Pat. Off. . | |
| 2101505 | 3/1972 | France . | |
| 3836290 | 4/1990 | Germany | 222/333 |
| 8912705 | 4/1991 | Germany . | |

*Primary Examiner*—Kevin P. Shaver
*Attorney, Agent, or Firm*—Wood, Herron & Evans

[57] ABSTRACT

A device (1) for finely atomizing fluids. A combination switch (18) is provided, with which an electric motor (4) for a pump (5) for spraying efficiency is activated and simultaneously the pressure compensation in the container (7) of the fluid is effected. Moreover, above the electric motor (4) with the pump (5) a space is created for storing batteries (16). Furthermore, a suction line (39), constructed of an elastic material and extending into the container (7) is helically formed, whereby a discharge of the fluid is also possible in an inclined or upside-down position of the container (7).

19 Claims, 3 Drawing Sheets

FINELY ATOMIZING DEVICE FOR FLUIDS

BACKGROUND OF THE INVENTION

The present invention relates to a finely atomizing device for fluids.

A device of the above-mentioned kind—for example a spray can or container—is well known by the German Utility Model G 89 12 705. The housing for the receipt of the aggregate block consisting of a motor i.e. an electric motor and a pump is tightly connected with a container for the spray fluid. The motor and the pump constructed as a gear pump are arranged vertically one upon the other, and a suction line is leading from the gear pump to the container for the fluid. The spraying nozzle at the top of the well-known device is connected with the outlet side of the gear pump by a pressure pipe.

There are already generally known and in commerce some spray systems including by finger pressure mechanically operating hydraulically-operating pumps for finely atomizing fluids in spray cans and bottles or flasks. In the case of these systems it is considered as a disadvantage that the spraying process starts not until the produced fluid pressure in the pump chamber is high enough. A continous spray stream is not obtainable with these known systems.

Already known from U.S. Pat. No. 4,618,099 is an electronic spray device with a spray mechanism inserted into a housing being connected with the container for the spray fluid by screwing. The spray mechanism consists of an electromotively driven pump, of which the suction line is conducted through an opening of the housing into the container. At the outlet side the pump is a pressure tube, which has mounted at its front end a discharge nozzle for the spray stream. The pressure tube with the discharge nozzle projects from the housing.

Although such well-known spray devices are harmless to the environment because of avoiding FCKW-materials (liquid gases) there are a number of disadvantages making the handling of the constructions more difficult and not guaranteeing an optimal function under different occuring conditions.

Therefore it is an object of the present invention to improve a spray device for finely atomizing fluids of the above-mentioned kind and thereby to avoid the described disadvantages of the known devices.

SUMMARY OF THE INVENTION

With the choosen arrangement of the electro motor and the pump connected with the motor, which can be a gear pump or a reciprocating pump, only little space is required in the housing. It is advantageous that the usually necessary pressure tube from the pump to the spraying nozzle is missing because pursuant to features of the invention the pump is directly connected with the spraying nozzle. In the present invention, only the receiver for the nozzle may have to be extended in a direction toward the outlet opening of the pump.

The arrangement of motor and pump permits a favorable dividing of the housing into two half-shells, which is simple in manufacturing and which creates a sufficiently large and well accessible chamber for placing the batteries or accumulators above the motor block.

A combination switch sets two functions simultaneously in motion by its operation. On the one hand a switching contact or a switch or a limit switch is activated which permits the energy supply to the motor for driving the pump, and whereby the switch acts upon the working order of the motor. On the other hand, in parallel with the effect of the switch to the motor, a valve is activated by which an air conduit is opened into the container of the fluid. In this way, immediately with the extraction of fluids a pressure compensation and thereby a continous extraction of fluids from the container is provided.

Finally, a unique suction line is provided with a ring or bow in the middle or final section thereof which guarantees in an optimal manner a total extraction of the fluids even when the container is inclined or even totally inverted.

As can be seen from the above-mentioned explanations, the combination of the many single features provided improved functioning of the device under diverse operating circumstances and further provides desired ease of handling.

Reference for more details and advantages may now be had to the following detailed description of an exemplary embodiment of a spray device for finely atomizing fluids, taken in conjunction with the accompanying drawings; in which:

DETAILED DESCRIPTION OF THE PREFERRED EMBODIMENT

Figure 1:
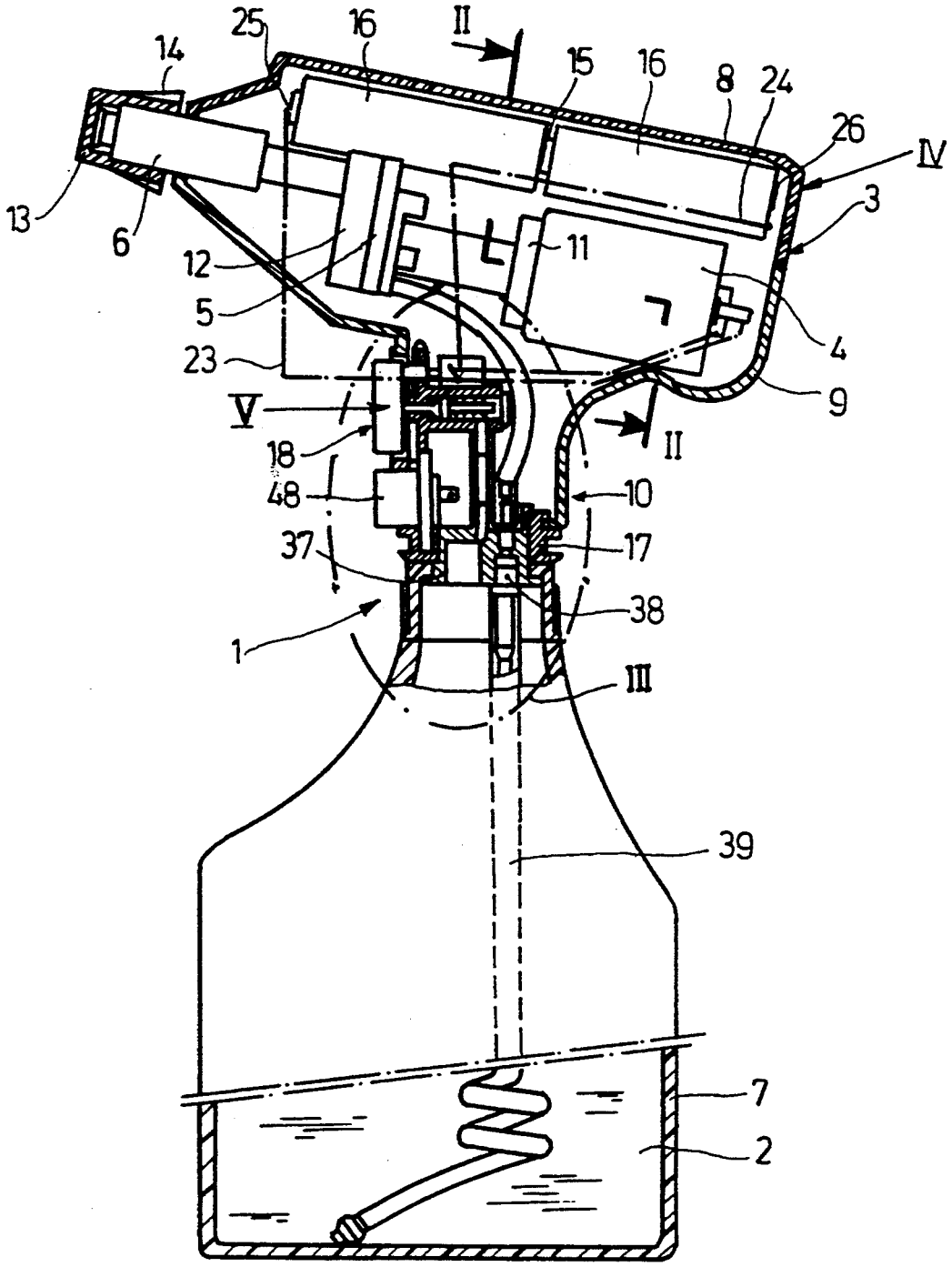
FIG.1 illustrates a diagrammatic view through a spray device for finely atomizing fluids.

The spray device such as a can or container 1 for finely atomizing fluids 2 essentially consists of a housing 3 for the receipt of the motor 4, the pump 5 connected with the motor and the nozzle 6 and the container 7 for the spray fluid 2. The housing 3 in FIG.1 consists of the upper half-shell 8 and the lower half-shell 9 connectable with a snap or screw connection. The upper half-shell 8 at the same time serves as a housing cover.

Figure 4:
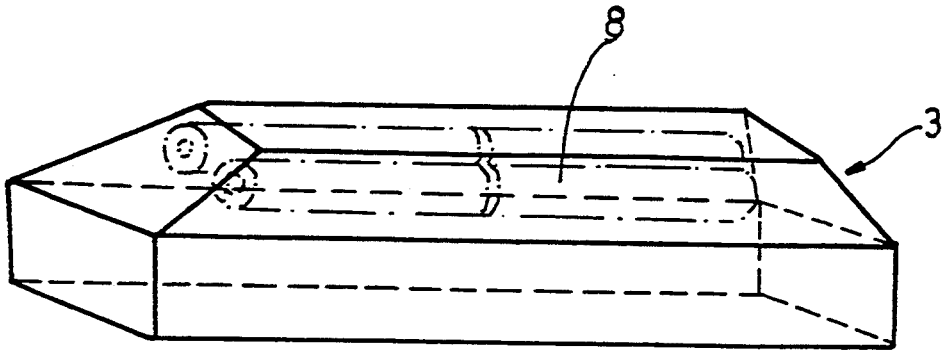
FIG.4 illustrates the housing cover of the aggregate housing in perspective view pursuant to the arrow IV in FIG. 1.
Figure 3:
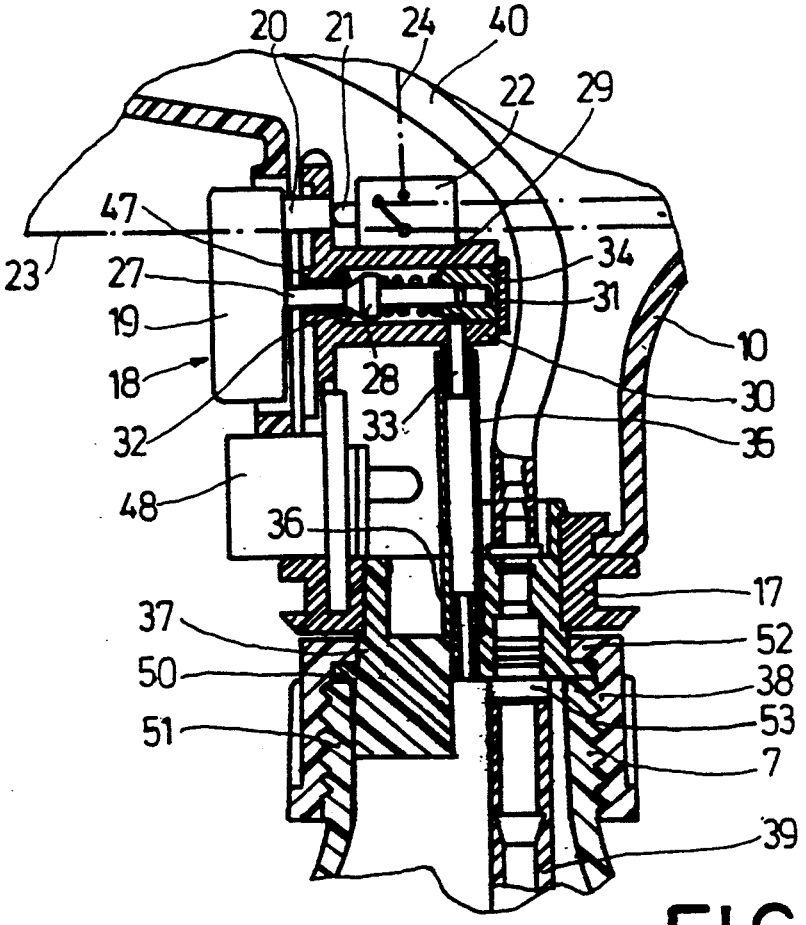
FIG. 3 illustrates a sectional view through the lower part of the housing pursuant to the circular line III in FIG. 1.

As can be ascertained from FIG.4 the housing cover 8 as a separate part can receive the batteries or accumulators 16 and equipped in this way can be slided on the lower housing shell 9. The sliding occurs in the longitudinal direction of the batteries or accumulators 16 in guide grooves and guide rails provided for it, whereby in the closed final position a locking takes place for keeping the housing cover in the closed position. The batteries respectively accumulators 16 are undetachable installed in the housing cover 8 and are electrically connected in the known series connection, for example by metal links. Simultaneously at closed housing cover 8 a beginning and final bonding with the lines 23 and 24 to the switch 22 occurs.

Instead of building the housing 3 out of two half-shells 8 and 9 of course other housing constructions are possible without departing from the scope of protection. So the cover 8 for example is made detachable from the housing and separately connectable to a charging set (not shown) for charging the accumulators 16 Thus it is possible to provide several housing boxes for a finely atomizing device. By this way accumulators can be charged continously to use the device continously.

As can be seen from FIG.1 the housing 3 when put together is a hollow cylindrically configured arranged horizontal or nearly horizontal, which passes over into a necked down base 10 in one piece or optionally more pieces serving as a handle. This base 10 again is essentially hollow cylindrically configured but arranged about vertical or under a small angle to the hollow cylinder of housing 3, as represented in FIG.1.

In the lower horizontal or nearly horizontal arranged halfshell 9 there is in the back part the motor 4 in a lying arrangement. The motor 4 is directly connected by a flange 11 with the pump 5 with well-known mechanical coupling elements, which is a gear pump in the shown example. The gear pump naturally can be replaced by other kinds of pumps, for example a piston-pump. The front cover 12 of the pump is at the outlet side of the pump connected with the nozzle 6, on which there is screwed and held from outside a spray diffuser 13 by a swivel nut 14.

Figure 2:
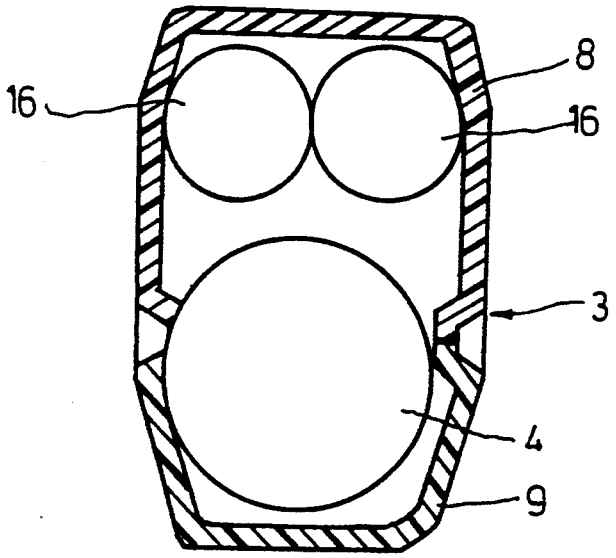
FIG.2 illustrates a diagrammatic view through the housing pursuant to the line II—II in FIG. 1.

Above the aggregate block of motor 4 and pump 5 is space 15 for the placement of the batteries or accumulators 16. Pursuant to FIGS. 1 and 2 in the space 15 of the upper half-shell 8 of the housing 3 altogether four batteries 16 are placed, of which two are arranged behind each other and two parallel to each other. The space 15 is equipped in such a manner that an electrical connection of the batteries or accumulators 16 in series is guaranteed, as explained exemplarily above for FIG.4.

The base 10 of the housing 3 consists at the end side of a coupling 17 for the fast and simple connection to neck *7a* of the container 7. Such a coupling 17 can be equipped with a bayonet lock, a screw cap or stick plug or something similar, whereas on principle it must be taken care that a fluid impermeable connection is used, available for example by adding a gasket respectively an O-ring seal. Such connections are generally known in state of art and therefore do not have to be explained here in detail.

In alignment to the front side of the device a combination switch 18 is mounted about in the middle part of the base 10 of the housing 3. This combination switch 18 consists of a manual push button 19 on the outside. A first ram 20 activates the push button 21 of an electric switch 22, for example a limit switch. The switch 22 for its part is electrically connected with the batteries or accumulators 16 by electric lines 23 and 24 to their positive pole 25 and negative pole 26 by connector blocks here not shown in detail.

Figure 5:
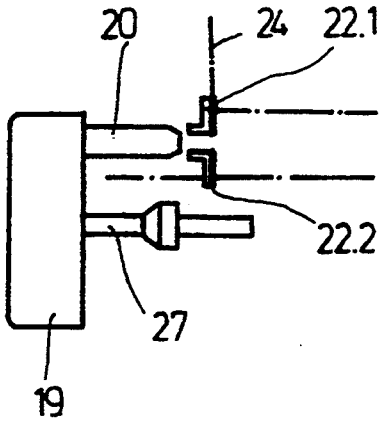
FIG.5 illustrates a combination switch with switching contact pursuant to the arrow V in FIG.1.

Instead of the switch 22 it is also possible pursuant to FIG.5 to provide just two distant opposite contacts 22.1 and 22.2 of electrically conductive material. On operation the ram 20 of the combination switch 18 is pushed between the contacts, thus electrically connecting the contacts 22.1 and 22.2. From the contacts 22.1 and 22.2 again lines are leaving to the batteries or accumulators 16 and to the electric motor 4.

A second ram of the combination switch 18 is constructed as a valve tappet 27 and consists of a valve disk 28 standing under the effect of a pressure spring 29. The valve tappet 27 is axially moveable inside the valve box 30 against a buffer 31. In the direction to the push button 19 between the valve disk 28 and the valve box 30 a gasket or an O-ring seal 32 is inserted. The valve box shows a radially leaving opening 33 placed in the back part of the valve box. A bottom plate 34 encloses the valve box 30 to the back, leaving an air gap between the valve box 30 and the bottom plate 34 in the region of the opening 33. While operating the push button 19 and the axially shifting of the valve tappet 27 the air gap 47 between the tappet 27 and the valve box 30 behind the gasket 32 is freed, making possible a free air conduit for a permanent pressure compensation in the container 7 through the opening 33.

The opening 33 is connected by a line 35 with an air inlet 36 in the coupling 37, which for its part joins the container 7 for the atomizing fluids 2. Thus at the discharge of the fluids always a pressure compensation inside the container 7 is guaranteed, as mentioned above.

The coupling 37 is fluid-impermeably pressed in within the coupling piece 17 and the nut 38 between the base 10 of the housing 3 and the container 7. Mounted on the coupling 37 is a ring flange 50 lying on the upper fore-part of the container 7. Outside on the upper connecting piece 51 of the container 7 a thread is provided, on which a nut 38 with corresponding inside thread is screwed. The nut 38 lies with its upper inwardly directed flange 52 in the sense of a swivel nut on the coupling 37. The coupling 37 is pressed in the coupling piece 17 in such a manner that the swivel nut 38 is left rotatable. In this way the housing 10 with the inserted aggregates and coupling elements is fluid-impermeably and operatively connected with the container 7.

In the coupling 37 a hose coupling 53 is solidly and again tightly fitted in, with which on the one hand the suction line 39 leading to the container 7 and at the other end the suction line 40 leading inside the housing 3 to the pump 5 are connected. The suction line 39 and the suction line 40 are advantageously made of an elastic material and therefore flexible and simple to be placed around componentries.

The suction line 39 leading inside the container 7 shows in its middle or final section a special design, which is admitted by the elastically deformable material. In the example of FIG. 1 the design is a helical formed winding 41, from which again an essentially unformed final piece 42 of the suction line 39 reaches the bottom 43 of the container 7. At the inlet side the the final piece 42 of suction line 39 respectively 42 consists of a suction cup or strainer 44, which is more weighty than the fluid 2 to be discharged and therefore it is always inclined to the lowest point in the container 7 indifferent to the position of the container 7 during its handling. Naturally it is possible to press the suction cup or strainer 44 directly into the winding.

Below the combination switch 18 in the base 10 of the housing 3 there is a socket 48 electrically connected with the accumulators 16 and permitting a charging of the accumulators 16.

In the position shown in FIG.1 while operating the combination switch 18 the pump 5 is driven by the electric motor 4 and absorbs through the suction strainer 44 and the suction lines 39 and 40 the fluid 2 and transports it to the spraying nozzle 6. When turning the container 7 with the total spray system in an inclined or upside-down position the fluid is primary in the head piece of the container 7. In such a position the fluid extraction is normally endangered, because the suction line does not dip any more with its inlet end into the fluid but floats in the air-filled area. Because of the helical formed winding 41 the suction line also upsets in the new position and dips always with its suction strainer in the fluid 2. With this construction a continous fluid discharge is guaranteed in all positions if the container 7 effecting a continous spray stream.

Instead of the helical formed winding 41 it is possible to choose also other designs such as serpentines, spirals, loops or similar kinds. For supporting and stabilizing of the modelling a spring (helical spring) can be inserted into the suction line. All these proceedings are not described in detail because their finishing is at the discretion of the expert. The essential character of the design of the suction line 39 respectively 40 is the following of the suction line to all directions and all angles during motion of the container. This is guaranteed by the suction line 39 consisting of an elastically formable material and possessing at least one ring or bow in about the middle or outlet side section formed essentially crosswise to the longitudinal axis 45 of the line 39 with a radius around this longitudinal axis 45 of the line 39. Because of the crosswise to the longitudinal axis 45 angular forming of the line 39 the stiffness of the suction line 39 is taken off and instead a high elastic movability is given.

I claim:

1. An atomizing device comprising:

a container for holding fluid to be atomized;

a pump operatively connected to said container for pumping fluid from said container;

a spray nozzle operatively connected to said container and said pump; and, a flexible suction line connected to an inlet of said pump and extending into said container, said suction line including a helically formed portion disposed within said container and imparting resilience to said suction line thereby causing an end of said suction line to remain in contact with fluid stored in said container during inversion thereof.

2. The device of claim 1 wherein said helically formed portion comprises at least two helical coils formed by said suction line.

3. The device of claim 2 wherein said helical coils are formed about a longitudinal axis of said suction line.

4. The device of claim 1 wherein said helically formed portion is formed about a longitudinal axis of said suction line.

5. The device of claim 1 wherein said pump is contained in a housing removably connected to said container, said housing further having a normally closed air conduit extending between the inside of said container and atmosphere, said housing further containing an electric motor for operating said pump, wherein a combination push button switch is operatively connected to both said air conduit and said motor such that upon activation of said push button switch, said motor is turned on and said conduit is opened to vent said container to atmosphere.

6. The device of claim 5 wherein an outlet of said pump is disposed substantially adjacent to said spray nozzle and is connected to a receiving element of said spray nozzle.

7. The device of claim 6 wherein said housing further includes at least one removable battery for providing power to said electric motor, said battery being disposed adjacent to said pump.

8. The device of claim 1 wherein said pump is an electromotive pump and said device further comprises an electric motor connected to said pump, said motor and said pump being contained in a housing removably connected to said container.

9. The device of claim 8 wherein said housing is comprised of two shells releasably fastened to one another and disposed on top of said container.

10. The device of claim 1 wherein said pump is an electromotive pump and said device further comprises an electric motor connected to said pump, said motor and said pump being contained in a housing connected to said container, said housing including an air conduit for venting said container to atmosphere and wherein a combination switch is provided and includes a first ram for activating said motor when said switch is depressed and a second ram connected to a valve for opening said conduit and venting said container to atmosphere through said conduit when said switch is depressed.

11. An atomizing device comprising:

a container for holding fluid to be atomized and including a necked down portion;

a housing having a necked down portion releasably secured to the necked down portion of said container, said necked down portions of said housing and said container together serving as a handle for gripping by a user;

a spray nozzle connected to said housing;

a pump disposed in said housing, said pump having an inlet connected for fluid communication with said container and an outlet connected to said spray nozzle;

an electric motor disposed in said housing and operatively connected to said pump;

at least one battery mounted in said housing adjacent said pump and said motor for supplying power to said motor; and, an operating switch mounted to said handle so as to be operable by a user when said necked down portions are gripped by the user, said switch being electrically connected between said battery and said motor for selectively activating said motor to drive said pump.

12. The device of claim 11 wherein said housing is formed of two shell portions releasably secured to one another.

13. The device of claim 11 wherein the inlet of said pump is connected to a suction line extending into said container, said suction line including a helically formed portion disposed within said container and imparting resilience to said suction line thereby causing an end of said suction line to remain in contact with fluid stored in said container during inversion thereof.

14. The device of claim 13 wherein said helically formed portion comprises at least two helical coils formed by said suction line.

15. The device of claim 14 wherein said helical coils are formed about a longitudinal axis of said suction line.

16. The device of claim 13 wherein said helically formed portion is formed about a longitudinal axis of said suction line.

17. The device of claim 11 wherein said housing further includes a normally closed air conduit extending between the inside of said container and atmosphere and said operating switch is a combination switch being operatively connected to both said air conduit and said motor such that upon activation of said push button switch, said motor is turned on and said conduit is opened to vent said container to atmosphere.

18. The device of claim 17 wherein said combination switch is a push button having first and second rams extending therefrom, said first ram being operatively connected to a switch for operating said motor and said second ram being operatively connected to a valve disposed in said conduit, whereby activation of said push button simultaneously energizes said motor and opens said valve to vent said conduit.

19. An atomizing device comprising:

a container for holding fluid to be atomized;

a housing connected to said container;

a spray nozzle connected to said housing;

a pump disposed in said housing, said pump having an inlet connected for fluid communication with said container and an outlet connected to said spray nozzle;

an electric motor disposed in said housing and operatively connected to said pump;

at least one battery mounted in said housing for supplying power to said motor;

a handle portion adapted to be gripped by a user and further including an air conduit leading between said container and atmosphere and a valve disposed in said air conduit for selectively opening and closing said air conduit; and, a push button mounted to said handle portion, said push button having first and second rams extending therefrom, said first ram being operatively connected to a switch for operating said motor and said second ram being operatively connected to said valve, whereby activation of said push button simultaneously energizes said motor and opens said valve.

* * * * *